US006186372B1

(12) United States Patent
Garcia et al.

(10) Patent No.: US 6,186,372 B1
(45) Date of Patent: Feb. 13, 2001

(54) DEVICE ENABLING A FLUID DISPENSER TO OPERATE BOTH THE RIGHTWAY UP AND UPSIDE-DOWN

(75) Inventors: Firmin Garcia, Evreux; Michel Brunet, Plufur; Aline Abergel, Boulogne-Billancourt, all of (FR)

(73) Assignee: Valois S.A., Le Nebourg (FR)

( * ) Notice: Under 35 U.S.C. 154(b), the term of this patent shall be extended for 0 days.

(21) Appl. No.: 09/351,722

(22) Filed: Jul. 12, 1999

(30) Foreign Application Priority Data

Jul. 23, 1998 (FR) ..... 98 09411

(51) Int. Cl.[7] ..... B65D 83/00
(52) U.S. Cl. ..... 222/402.19
(58) Field of Search ..... 222/402.19, 321.1, 222/321.4, 378

(56) References Cited

U.S. PATENT DOCUMENTS

| | | | | |
|---|---|---|---|---|
| 4,277,001 | | 7/1981 | Nozawa . | |
| 4,775,079 | * | 10/1988 | Grothoff | 222/321 |
| 4,887,744 | | 12/1989 | Williams . | |
| 4,966,313 | * | 10/1990 | Lina | 222/402.19 |
| 5,115,980 | * | 5/1992 | Skorka | 222/321 |
| 5,222,636 | * | 6/1993 | Meuresch | 222/321 |
| 5,341,967 | * | 8/1994 | Silvenis | 222/376 |
| 5,346,104 | | 9/1994 | Jeong . | |
| 5,979,712 | * | 11/1999 | Montaner et al. | 222/321.4 |

FOREIGN PATENT DOCUMENTS

| | | |
|---|---|---|
| 90 02 370 U1 | 6/1990 | (DE) . |
| 0 234 969 A1 | 9/1987 | (EP) . |
| 0 721 803 A2 | 7/1996 | (EP) . |

* cited by examiner

*Primary Examiner*—Kevin Shaver
*Assistant Examiner*—David Deal
(74) *Attorney, Agent, or Firm*—Rocky, Millnamow & Katz, Ltd.

(57) ABSTRACT

A device enabling a fluid dispenser to operate both in the upside-down position and in the rightway-up position, the dispenser comprising a fluid tank, and a dispenser member having an inlet and a dip tube, said device having a chamber in communication with said inlet of the dispenser member, said chamber having a top inlet and a bottom inlet that are selectively closable by respective top and bottom check valves, the top check valve having a moving valve element suitable for closing the top inlet of the chamber in the rightway-up position, wherein the bottom check valve has a moving valve element that floats, being of a density that is lower than the density of the fluid, and being adapted to close the bottom inlet of the chamber in the upside-down position when the chamber is filled with the fluid.

11 Claims, 1 Drawing Sheet

DEVICE ENABLING A FLUID DISPENSER TO OPERATE BOTH THE RIGHTWAY UP AND UPSIDE-DOWN

The present invention relates to a device enabling a fluid dispenser to operate both the rightway up and upside-down, the dispenser generally comprising a tank of fluid and a dispenser member such as a pump or a valve. Naturally, the device is applicable only to dispensers making use of an air intake, i.e. dispensers where the dispensed fluid is replaced by air penetrating into the tank. For this purpose, the dispenser generally has a dip tube mounted on the inlet of the dispenser member and extending towards the bottom of the tank.

BACKGROUND OF THE INVENTION

In a conventional dispenser, it is not possible to operate the dispenser in the upside-down position since the free end of the dip tube is no longer immersed in the fluid but is in the air that is present in the tank. Consequently, after the dispenser has been actuated one, two or three times, no more fluid is dispensed.

The present invention thus relates to a device enabling such a conventional dispenser to operate even when in the upside-down position.

Such devices enabling operation to take place in the upside-down position are known in the prior art, and in particular from document FR-2 627 708 which describes a device for mounting between the dip tube and the inlet of the pump or valve, said device having two inlets, each provided with a respective ball check valve. The balls are metal balls and they are urged by gravity against their respective valve seats. In the rightway-up position, the ball in one of the two check valves rests in sealed manner against its valve seat, thereby preventing air from entering into the dispenser. Conversely, when the dispenser is in the upside-down position the ball of the other check valve rests against its corresponding valve seat and also prevents air from penetrating into the dispenser. Consequently, that device makes use of two check valves operating under the control of gravity to close in selective manner an inlet which communicates with the tank. It should nevertheless be observed that the design of such a device is made relatively complicated by the fact that each ball must be housed in a defined space in which it is held captive. Such a design requires at least three parts to be implemented and assembly thereof is very complicated.

OBJECTS AND SUMMARY OF THE INVENTION

An object of the present invention is to remedy the drawbacks of the above-mentioned prior art by defining another device in which the number of component parts is kept to a minimum and which is very simple to assemble.

To do this, the present invention provides a device enabling a fluid dispenser to operate equally well in the upside-down position and in the rightway-up position, the dispenser comprising a fluid tank and a dispenser member such as a pump or a valve, the dispenser member having an inlet and a dip tube extending into the tank, said device being disposed between the inlet of the dispenser member and the dip tube, said device comprising a chamber in communication with said inlet of the dispenser member, said chamber comprising a top inlet and a bottom inlet selectively closable respectively by a top check valve and by a bottom check valve as a function of the upside-down position or the rightway-up position of the dispenser, the top check valve having a moving valve element adapted to close the top inlet of the chamber in the rightway-up position, wherein the bottom check valve has a moving valve element that floats, being of density smaller than that of the fluid and being adapted to close the bottom inlet of the chamber in the upside-down position when the chamber is full of the fluid. Unlike the above-described prior art device, the bottom check valve does not operate under gravity to close the bottom inlet to the chamber, but operates by buoyancy because its density is lower than that of the fluid to be dispensed. It is thus possible for this valve element to be constituted by a ball of plastics material.

The valve element of the top check valve is of a density that is greater than that of the fluid. Advantageously, the top valve element is constituted by a weight that is driven by gravity even when immersed so as to press against a top valve seat when in the rightway-up position. Preferably, the mass consists in a cylindrical metal sleeve having a bottom end adapted to come into sealed contact with the top valve seat in the rightway-up position. In which case, the device can be constituted by a body and by an inner bushing engaged in said body, the dip tube being mounted on the body, and the inner bushing being fixed to the inlet of the dispenser member, the body forming the bottom inlet and the bushing forming the top inlet, the chamber being formed between the body and the bushing. Advantageously, the top inlet into the inner bushing is defined by at least one flow opening whose edges form the top valve seat against which the bottom end of the cylindrical metal sleeve comes into sealing contact in the rightway-up position.

According to another characteristic, the inner bushing defines an outlet channel of the chamber in communication with the inlet of the dispenser member, said outlet channel of the chamber having a mouth shaped in such a manner as to prevent said channel being closed by the floating bottom valve element. Also, the bottom valve seat is defined by the body in the form of a frustoconical surface that flares upwards in the rightway-up position, whereas the above-described prior art device uses at least three component parts, it is possible to make the device of the invention using only two parts because the top moving valve element is limited in its displacement by the dispenser member.

BRIEF DESCRIPTION OF THE DRAWING

The invention is described below in greater detail with reference to the accompanying drawing showing an embodiment of the invention by way of non-limiting example.

In the drawing.

MORE DETAILED DESCRIPTION

Figure 1:
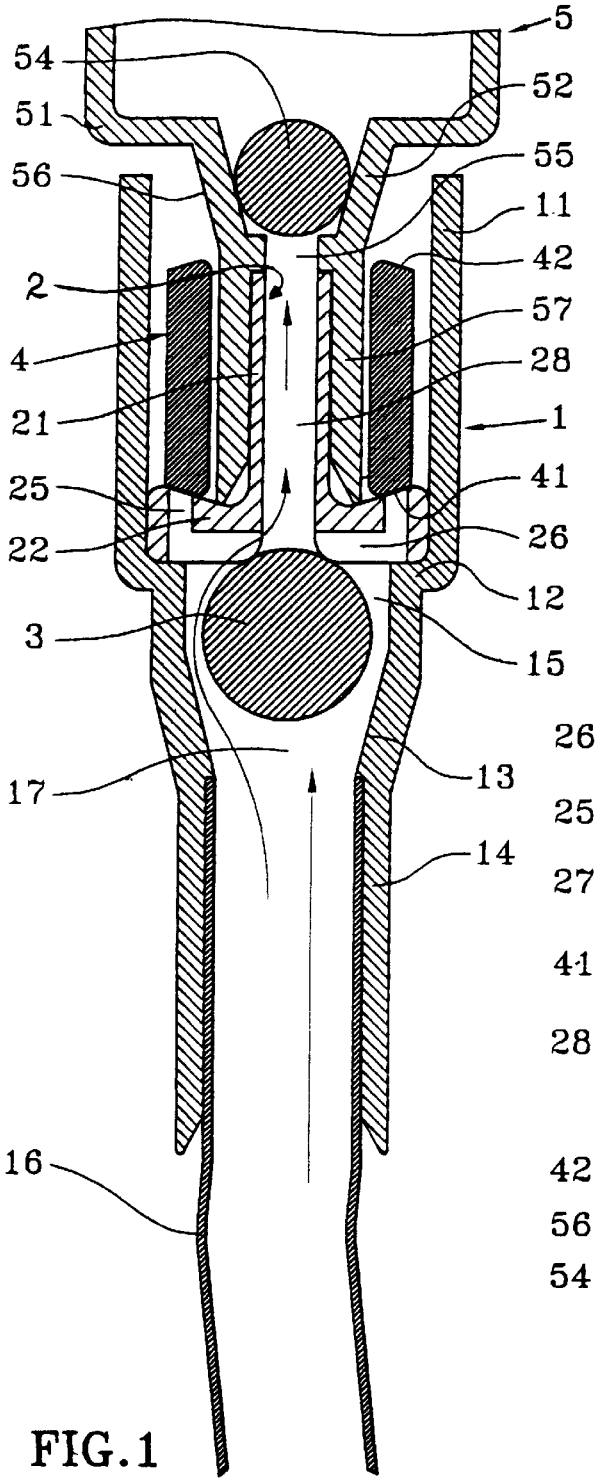
FIG. 1 is a cross-section view through a device of the present invention in the rightway-up position.
Figure 2:
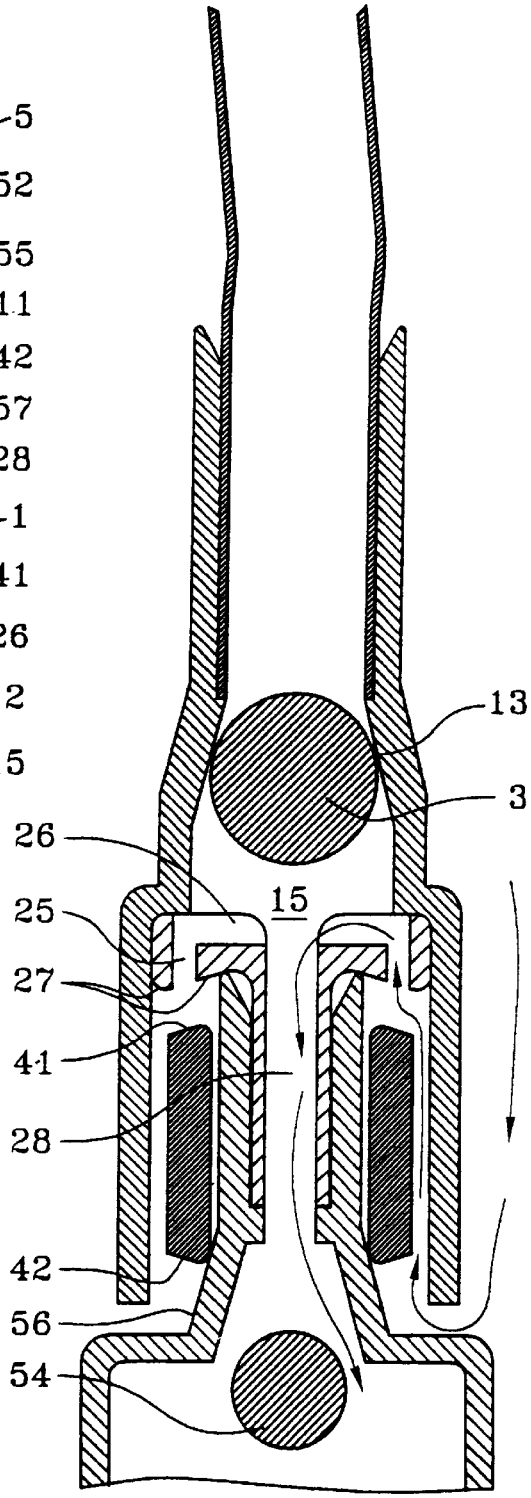
FIG. 2 is a view of the FIG. 1 device in the upside-down position.

The device selected for illustrating the present invention and shown in FIGS. 1 and 2 comprises four component parts, namely two fixed parts and two moving parts. Compared with the above-described prior art device, this constitutes a significant advantage. The two fixed parts are constituted by a substantially cylindrical body 1 and by an inner bushing 2. These two parts can be molded out of plastics material. The body 1 is a hollow piece constituted by a top cylinder 11 which is extended at its bottom end by an inwardly-directed shoulder 12 from which there extends downwards a frustoconical portion 13 followed by a bottom end cylinder 14. The body 1 thus forms an inner shoulder 12 which defines an annular bearing surface. On the inside, the frustoconical portion 13 defines a frustoconical surface which serves as a seat for a check valve, as described below. The bottom cylinder 14 serves as a connection sleeve for engaging an extension tube 16.

The inner bushing 2 is constituted by a hollow rod 21 whose bottom end connects with an annular collar 22 which projects outwards. The inner bushing 2 thus defines an outlet channel 28. The inner bushing 2 is disposed inside the body 1 with the annular collar 22 bearing against the shoulder 12. This annular collar 22 performs numerous functions in addition to that of bearing against the body 1. Firstly, it co-operates with the frustoconical portion 13 of the body 1 to define a chamber 15 within which a floating ball 3 is housed, e.g. a ball made of plastics material. When the device is in the rightway-up position as shown in FIG. 1, the ball 13 rests on its valve seat 13 without providing sealing, or at least without providing good sealing. However, when the chamber 15 is full of liquid and the device is in the upside-down position as shown in FIG. 2, the floating ball 3 is in sealing contact with the frustoconical seat 13, thereby closing the bottom inlet leading to the dip tube because the density of the ball is smaller than that of the liquid. Unlike most check valve members which are generally constituted by balls made of steel, the valve member of the present invention for selectively closing the bottom inlet of the device in communication with the dip tube 16 is constituted by a ball which is preferably made of plastics material and which floats when it is immersed in a liquid because of its buoyancy. As a result, when the device is the rightway up as shown in FIG. 1, and when the fluid is sucked up the dip tube 16, the floating ball 3 is lifted off its frustoconical seat 13 both because it is driven by the rising flow of liquid, and because it floats in the presence of the liquid. The fluid can thus penetrate into the chamber 15 through the bottom inlet and can flow from there along the outlet channel 28 formed inside the rod 21 of the inner bushing 2. Consequently, the inner bushing 2 has the function of defining a space which forms a chamber 15 within which a floating ball 3 is held captive.

Another function of the annular collar 22 is to define a top inlet 25 which also allows the chamber 15 to communicate with the outside. The top inlet 25 is formed by a plurality of fluid flow openings circumferentially distributed around the annular collar 22. The flow openings 25 extend from the top annular surface of the collar 22 to its bottom annular surface where they are united via radial grooves 26 for the purpose of guaranteeing that fluid can flow when the floating bead 3 is pressed against the annular collar 22, as shown in FIG. 1.

In accordance with the invention, the edges of the flow openings 25 define an annular valve seat 27 that can be seen in FIG. 2. This annular valve seat co-operates with a moving valve element 4 mounted to come into sealing contact with the seat 27 formed in this way. In accordance with the invention, this moving valve member comprises a cylindrical sleeve 4 of density greater than that of the fluid. The cylindrical sleeve 4 is preferably made of metal, e.g. of steel. The cylindrical metal sleeve 4 is disposed inside the top cylinder 11 of the body 1 concentrically around the rod 21 of the inner bushing 2. It has a bottom end 41 shaped so as to match the shape of the seat 27 formed by the collar 22 of the inner bushing 2. Consequently, when the device is in the rightway-up position as shown in FIG. 1, the top inlet 25 of the chamber 5 is closed in sealed manner by the cylindrical metal sleeve 4, independently of whether or not it happens to be immersed in liquid. Conversely, as soon as the device is in its upside-down position, as shown in FIG. 2, the cylindrical metal sleeve leaves its seat 27 under gravity so that the top inlet 25 is open and the liquid can penetrate inside the chamber 15 through the top inlet 25 from the end of the top cylinder 11, as shown by the flow arrows in FIG. 2.

In FIGS. 1 and 2, the device of the invention is shown mounted on a dispenser member such as a pump or a valve and it is given numerical reference 5 in the figures. Regardless of whether it is constituted by a pump or by a valve, it has a pump or valve body which is constituted by a body 51 represented solely by the bottom end thereof being shown in the figures. The pump or valve body forms a frustoconical valve seat 52 in which there is received a bottom check-valve ball 54, e.g. made of steel. Beneath the valve seat 52, the body 51 forms a connection sleeve 57 which is normally adapted to receiving a conventional dip tube. This is a completely conventional design for the bottom portion of a pump or a valve. The bottom valve ball 54 closes the inlet 55 of the pump or valve chamber formed by the body 51. In accordance with the invention, the device for operating in the upside-down position is connected to the sleeve 57 by means of the rod 21 which replaces the conventional dip tube that is normally inserted therein. The rod 25 can advantageously be adapted in length so that it is completely engaged inside the sleeve 57, with the bottom end of the connection sleeve 57 coming into abutment against the top surface of the annular collar 22. It is essential for the invention that the inside diameter of the cylindrical metal sleeve 4 is greater than the outside diameter of the connection sleeve 57 of the body 51 so that the sleeve can move freely axially over a certain distance to enable the top inlet 55 of the chamber 15 to be opened selectively. In accordance with a particularly advantageous characteristic and which serves in particular to reduce the number of parts required, the displacement of the cylindrical metal sleeve 4 is restricted in height by the body 51 of the valve or the pump 5. In the embodiment shown in FIGS. 1 and 2, the limit on the displacement of the sleeve 4 is provided by the frustoconical portion 52 of the body 51 forming the inside of the sleeve for the bottom valve ball 54. The outer surface 56 thus forms an abutment surface against which the top end of the sleeve 42 comes into abutment when the device is in the upside-down position as shown in FIG. 2. There is therefore no need for the device to include a special additional part having the function of defining an abutment surface for the cylindrical metal sleeve 4. This saves one component part in the device.

The operation of the device is described briefly below with reference to FIGS. 1 and 2 in succession, respectively when it is the rightway up and when it is upside-down. When the fluid dispenser incorporating a device of the invention is held the rightway up, as shown in FIG. 1, the top inlet 25 of the chamber 15 is closed in sealed manner by the bottom end of the cylindrical sleeve 4 resting on the valve seat 27. The dip tube 16 extends into the fluid so that suction created within the dispenser member 5 has the effect of sucking up the fluid inside the dip tube 16. The fluid sucked up in this way lifts the floating ball 3 off its seat 13 and presses it against the annular collar 22 in which there are provided the flow grooves 26 providing communication between the chamber 15 and the outlet channel 28 which communicates with the inlet 55 of the dispenser member. In the same manner, the ball 54 of the inlet check valve of the dispenser member is lifted off its seat 52 by the flow of fluid sucked up in this way. Unlike the bottom check-valve ball 54 of the dispenser member 5, the ball 3 floats, thereby making it easier to lift off the bottom valve seat 13. Conversely, when the dispenser is held in the upside-down position, as shown in FIG. 2, the cylindrical metal sleeve 4 leaves its seat 27 to come into abutment via its top end 42 with the frustoconical wall 56 formed by the body 51 of the dispenser member 5. The top inlet 25 of the chamber 15 is then open. Because the distributor is in the upside-down position, the fluid is situated in the vicinity of the dispenser member, and the top cylinder 11 of the body of the device. When suction is established inside the body of the dispenser member 5, this has the effect of sucking in the fluid which follows a path as represented by arrows in FIG. 2. The effect of the fluid penetrating into the chamber 15 is to lift the floating ball 3 which then presses in sealed manner against its seat 13 as shown in FIG. 2. It is thus not possible to suck air in through the dip tube 16 whose end is then in air. The fluid therefore passes between the top end of the cylinder 11 and the body 51 of the dispenser member, and then between the sleeve 4 and the cylinder 11, and then between the top inlet 25 and the flow grooves 26, so as to reach the inside of the outlet duct 28, and finally penetrate into the pump body by lifting the bottom valve ball 54. Once suction is over, and the chamber 15 is no longer filled with the fluid, the floating ball 3 drops back onto the annular collar 22 of the inner bushing 2.

By means of the device of the invention, it is possible to use a fluid dispenser in any position. In addition, it should be observed that the device is constituted by four component parts only, two of which are fixed and two of which are moving, and they are very simple to assemble together since it suffices initially to place the floating ball 3 inside the body 1, then to insert the inner bushing 2 inside the body 1, and finally to place the cylindrical sleeve 4 around the bushing 2 inside the body 1.

What is claimed is:

1. A device enabling a fluid dispenser to operate equally well in the upside-down position and in the rightway-up position to dispense a fluid having a predetermined density, the dispenser comprising a fluid tank and a dispenser member such as a pump or a valve, the dispenser member having an inlet and a dip tube extending into the tank, said device being disposed between the inlet of the dispenser member and the dip tube, said device comprising a chamber in communication with said inlet of the dispenser member, said chamber comprising a top inlet and a bottom inlet selectively closable respectively by a top check valve and by a bottom check valve as a function of the upside-down position or the rightway-up position of the dispenser, the top check valve having a moving valve element adapted to close the top inlet of the chamber in the rightway-up position, wherein the bottom check valve has a moving valve element that floats in said fluid and that has a density that is less than said predetermined density of said fluid, said moving valve element being adapted to close the bottom inlet of the chamber in the upside-down position when the chamber is full of the fluid.

2. A device according to claim 1, in which the bottom valve element, when immersed in the fluid, is urged by its buoyancy against a bottom valve seat.

3. A device according to claim 2, constituted by a body and by an inner bushing engaged in said body, the dip tube being mounted on the body, and the inner bushing being fixed to the inlet of the dispenser member, the body forming the bottom inlet and the bushing forming the top inlet, the chamber being formed between the body and the bushing, and in which the bottom valve seat is defined by the body in the form of a frustoconical surface that flares upwards in the rightway-up position.

4. A device according to claim 1, in which the bottom valve element consists in a ball of plastics material.

5. A device according to claim 1, in which the top valve element is of a density that is greater than that of the fluid.

6. A device according to claim 5, in which the top valve element consists in a mass urged by gravity, even when immersed, against a top valve seat when the device is in the rightway-up position.

7. A device according to claim 6, in which the mass consists in a cylindrical metal sleeve having a bottom end adapted to come into sealed contact with the top valve seat in the rightway-up position.

8. A device according to claim 7, constituted by a body and by an inner bushing engaged in said body, the dip tube being mounted on the body, and the inner bushing being fixed to the inlet of the dispenser member, the body forming the bottom inlet and the bushing forming the top inlet, the chamber being formed between the body and the bushing, and in which the top inlet into the inner bushing is defined by at least one flow opening whose edges form the top valve seat against which the bottom end of the cylindrical metal sleeve comes into sealing contact in the rightway-up position.

9. A device according to claim 1, constituted by a body and by an inner bushing engaged in said body, the dip tube being mounted on the body, and the inner bushing being fixed to the inlet of the dispenser member, the body forming the bottom inlet and the bushing forming the top inlet, the chamber being formed between the body and the bushing.

10. A device according to claim 9, in which the inner bushing defines an outlet channel of the chamber in communication with the inlet of the dispenser member, said outlet channel of the chamber having a mouth shaped in such a manner as to prevent said channel being closed by the floating bottom valve element.

11. A device according to claim 1, in which the moving top valve element has its displacement limited by the dispenser member.

* * * * *